US011749204B1

(12) United States Patent
Zhou et al.

(10) Patent No.: US 11,749,204 B1
(45) Date of Patent: Sep. 5, 2023

(54) DISPLAY PANEL AND DRIVE CIRCUIT OF THE SAME

(71) Applicant: HKC Corporation Limited, Guangdong (CN)

(72) Inventors: Mancheng Zhou, Guangdong (CN); Yuanping Zhang, Guangdong (CN); Shuang Wang, Guangdong (CN); Peng Ren, Guangdong (CN); Hao Tang, Guangdong (CN); Xinghan Liu, Guangdong (CN); Haijiang Yuan, Guangdong (CN)

(73) Assignee: HKC CORPORATION LIMITED, Guangdong (CN)

( * ) Notice: Subject to any disclaimer, the term of this patent is extended or adjusted under 35 U.S.C. 154(b) by 0 days.

(21) Appl. No.: 18/090,760

(22) Filed: Dec. 29, 2022

(30) Foreign Application Priority Data

Mar. 3, 2022 (CN) ..... 202210203546.1

(51) Int. Cl.
*G09G 3/3258* (2016.01)
*G09G 3/3266* (2016.01)

(52) U.S. Cl.
CPC ..... *G09G 3/3258* (2013.01); *G09G 3/3266* (2013.01); *G09G 2300/0842* (2013.01)

(58) Field of Classification Search
CPC ..... G09G 3/3258; G09G 3/3266; G09G 2300/0842
See application file for complete search history.

(56) References Cited

U.S. PATENT DOCUMENTS

2015/0049126 A1 2/2015 Jung

FOREIGN PATENT DOCUMENTS

| | | | | |
|---|---|---|---|---|
| CN | 108538248 A | 9/2018 | | |
| CN | 106782330 B | 3/2019 | | |
| CN | 110176213 A | 8/2019 | | |
| CN | 107610652 B | 11/2019 | | |
| CN | 110268465 B | 7/2022 | | |
| CN | 112489599 B | 9/2022 | | |
| WO | WO-2021169413 A1 * | 9/2021 | ..... | G09G 3/3258 |

OTHER PUBLICATIONS

First Office Action issued in corresponding CN Application No. CN202210203546.1, dated Apr. 20, 2022, pp. 1-8, Beijing, China.

* cited by examiner

*Primary Examiner* — Stacy Khoo
(74) *Attorney, Agent, or Firm* — Scully, Scott, Murphy & Presser, P.C.

(57) ABSTRACT

A display panel and a drive circuit of the same are provided. The drive circuit includes multiple drive circuit rows. Each of the drive circuit rows includes multiple pixel drive circuits and a signal processing circuit. According to the drive circuit, a signal processing circuit can obtain a drive signal by processing a scan signal and a light-emitting control signal of a drive circuit row to which the signal processing circuit belongs, and can output the drive signal to each pixel drive circuit in the drive circuit row to which the signal processing circuit belongs; a pixel drive circuit can form a capacitor-reset loop by multiplexing a first switch tube in a light-emitting element reset loop of the pixel drive circuit, a second switch tube in a data-writing loop of the pixel drive circuit, and a third switch tube in a light-emitting loop of the pixel drive circuit.

20 Claims, 10 Drawing Sheets

Related Art

DISPLAY PANEL AND DRIVE CIRCUIT OF THE SAME

CROSS-REFERENCE TO RELATED APPLICATIONS

This application claims priority under 35 U.S.C. § 119(a) to Chinese Patent Application No. 202210203546.1, filed Mar. 3, 2022, the entire disclosure of which is incorporated herein by reference.

TECHNICAL FIELD

This application relates to the field of display panels, and particularly to a display panel and a drive circuit of the same.

BACKGROUND

Since an Organic Light-Emitting Diode (OLED) display has advantages of low power consumption, fast response speed, wide viewing angle, etc., the OLED display is becoming more and more widespread. At present, a considerable number of OLED displays on the market adopt a 7T1C pixel drive circuit. As illustrated in FIG. 1, a drive circuit of each pixel unit includes seven Thin Film Transistors (TFT) and one energy-storage capacitor C. A working process of the 7T1C pixel drive circuit in one frame of scan period is as follows. In a capacitor-reset phase, a scan signal SCAN(n−1) of a previous pixel row controls a switch tube T7 to be switched on, and thus, an initialization voltage Vint can reset a voltage of an end of the energy-storage capacitor C through the switched-on switch tube T7. In a data-writing phase, a scan signal SCAN(n) of a present pixel row controls switch tubes T1, T2, and T5 to be switched on, and a switch tube T4 is switched on in response to receiving the initialization voltage Vint at a gate of the switch tube T4, and thus, a data signal DATA can be written, that is, the energy-storage capacitor C is charged with the data signal DATA through the switched-on switch tubes T5, T4, and T2, and at the same time, the initialization voltage Vint can reset a voltage of an anode of a light-emitting element OLED through the switched-on switch tube T1. In a light-emitting phase, a light-emitting control signal EM(n) controls switch tubes T3 and T6 to be switched on, and the switch tube T4 is switched on in response to receiving the data signal DATA at the gate of the switch tube T4, so that the light-emitting element OLED can emit lights by receiving a drive voltage ELVDD at the anode of the light-emitting element OLED through the switched-on switch tubes T6, T4, and T3.

Since the number of TFTs in the 7T1C pixel drive circuit is relatively large, the pixel drive circuit occupies a relatively large area in a display region, which leads to reduction in a layout area of the light-emitting element OLED. As a result, the number of light-emitting elements OLED arranged per unit area is reduced, which is not conducive to improving a resolution of a display screen when the display region of the display screen is fixed in size.

SUMMARY

The disclosure provides a drive circuit of a display panel. The drive circuit includes multiple drive circuit rows. The drive circuit rows each include multiple pixel drive circuits and a signal processing circuit electrically coupled with the multiple pixel drive circuits. The pixel drive circuits each include a light-emitting element, an energy-storage capacitor, a capacitor-reset loop, a light-emitting element reset loop, a data-writing loop, and a light-emitting loop. The pixel drive circuit is configured to drive the light-emitting element to emit lights. The capacitor-reset loop is conductive in a capacitor-reset phase, and configured to reset a voltage of a first end of the energy-storage capacitor by receiving a first reset voltage. The light-emitting element reset loop is conductive in a data-writing phase, and configured to reset a voltage of an anode of the light-emitting element by receiving a second reset voltage. The light-emitting element reset loop includes the light-emitting element and a first switch tube electrically coupled with the anode of the light-emitting element. The first switch tube is configured to receive the second reset voltage in the data-writing phase. The data-writing loop is conductive in the data-writing phase, and configured to adjust the voltage of the first end of the energy-storage capacitor by receiving a data signal. The data-writing loop includes the energy-storage capacitor and a second switch tube electrically coupled with the first end of the energy-storage capacitor. The light-emitting loop is conductive in a light-emitting phase, and configured to drive the light-emitting element to emit lights by receiving a drive voltage. The light-emitting loop includes the light-emitting element and a third switch tube electrically coupled with the anode of the light-emitting element. The capacitor-reset loop includes the first switch tube, the third switch tube, the second switch tube, and the energy-storage capacitor which are connected in series in sequence. The first switch tube is further configured to receive the first reset voltage in the capacitor-reset phase. The signal processing circuit is configured to generate a drive signal according to a scan signal and a light-emitting control signal of a drive circuit row to which the signal processing circuit belongs. The drive signal at least includes a first drive signal and a second drive signal. The first drive signal is used to switch on the first switch tube and the second switch tube in the capacitor-reset phase and the data-writing phase. The second drive signal is used to switch on the third switch tube in the capacitor-reset phase and the light-emitting phase.

The disclosure further provides a display panel. The display panel includes a gate-signal generating circuit, a reset-voltage generating circuit, and the above drive circuit. The gate-signal generating circuit is electrically coupled with the drive circuit, and configured to generate the scan signal and the light-emitting control signal to output to the drive circuit. The reset-voltage generating circuit is electrically coupled with the drive circuit, and configured to generate the first reset voltage and the second reset voltage to output to the drive circuit.

Figure 1:
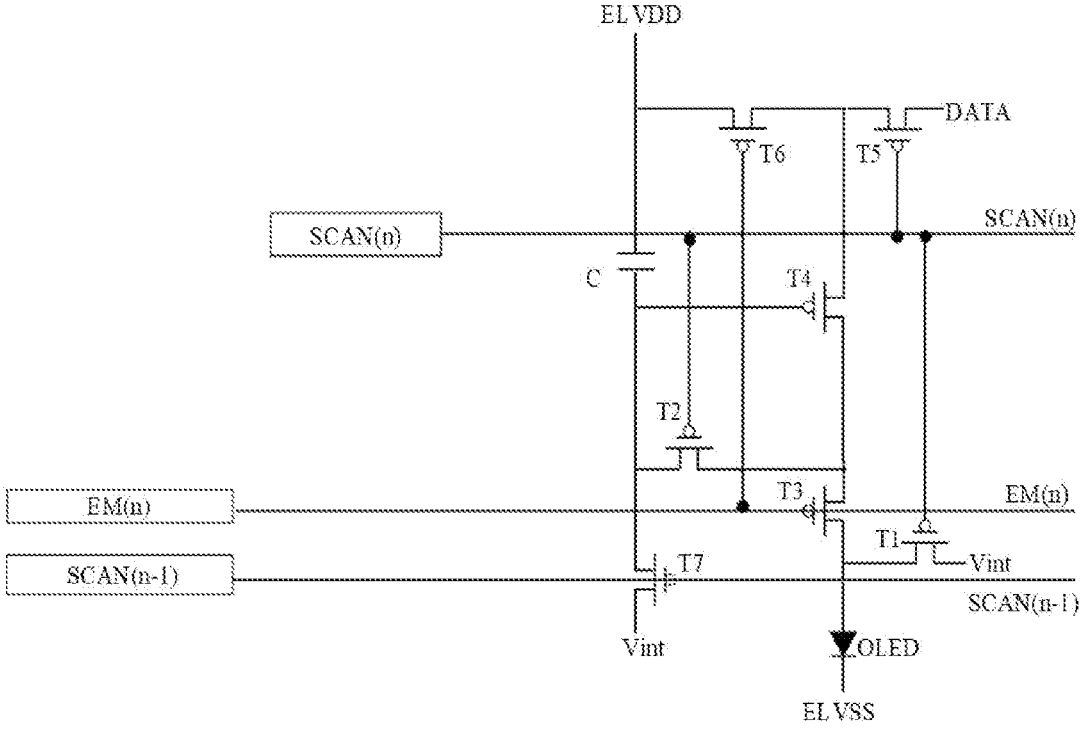
FIG. 1 is a schematic diagram illustrating a circuit structure of an exemplary pixel drive circuit.

Reference signs of main components:

| | |
|---|---|
| display panel | 1 |
| drive circuit | 100 |
| drive circuit row | 1000 |
| light-emitting element | 200 |
| gate-signal generating circuit | 300 |
| reset-voltage generating circuit | 400 |
| power-supply voltage generating circuit | 500 |
| data-signal generating circuit | 600 |
| capacitor-reset loop | L1 |
| light-emitting element reset loop | L2 |
| data-writing loop | L3 |
| light-emitting loop | L4 |
| signal processing circuit | 10 |
| pixel drive circuit | 20 |
| reset-voltage switching circuit | 30 |
| first switch tube | T1 |
| second switch tube | T2 |
| third switch tube | T3 |
| fourth switch tube | T4 |
| fifth switch tube | T5 |
| sixth switch tube | T6 |
| seventh switch tube | M1 |
| eighth switch tube | M2 |
| first phase-inverter | D1 |
| second phase-inverter | D2 |
| energy-storage capacitor | C |
| first input-end | 101 |
| second input-end | 102 |
| first output-end | 103 |
| second output-end | 104 |
| third output-end | 105 |
| fourth output-end | 106 |
| first voltage-input-end | 301 |
| second voltage-input-end | 302 |
| voltage-output-end | 303 |
| drive-signal line | 601, 602, 603, 604 |

The disclosure will be further depicted below with reference to specific implementations and accompanying drawings.

DETAILED DESCRIPTION

Hereinafter, technical solutions of implementations of the disclosure will be depicted in a clear and comprehensive manner with reference to accompanying drawings intended for these implementations. Apparently, implementations described below merely illustrate some implementations, rather than all implementations, of the disclosure. All other implementations obtained by those of ordinary skill in the art based on the implementations of the disclosure without creative efforts shall fall within the protection scope of the disclosure.

In description of the disclosure, it should be noted that, orientations or positional relationships indicated by the terms "upper", "lower", "left", "right", and the like are based on orientations or positional relationships illustrated in the accompanying drawings, and are only for convenience of describing the disclosure and simplifying the description, rather than indicating or implying that the referred device or element must have a specific orientation, be constructed and operated in a specific orientation, and therefore should not be construed as a limitation of the disclosure. In addition, the terms "first", "second", and the like are used for descriptive only and should not be construed to indicate or imply relative importance.

The disclosure provides a display panel and a drive circuit of the same, which aim to solve a problem of affecting resolution improvement caused by a relatively large number of Thin Film Transistors (TFT) in a pixel drive circuit of an existing display panel.

The disclosure provides a drive circuit of a display panel. The drive circuit includes multiple drive circuit rows. The drive circuit rows each include multiple pixel drive circuits and a signal processing circuit electrically coupled with the multiple pixel drive circuits. The pixel drive circuits each include a light-emitting element, an energy-storage capacitor, a capacitor-reset loop, a light-emitting element reset loop, a data-writing loop, and a light-emitting loop. The pixel drive circuit is configured to drive the light-emitting element to emit lights. The capacitor-reset loop is conductive in a capacitor-reset phase, and configured to reset a voltage of a first end of the energy-storage capacitor by receiving a first reset voltage. The light-emitting element reset loop is conductive in a data-writing phase, and configured to reset a voltage of an anode of the light-emitting element by receiving a second reset voltage. The light-emitting element reset loop includes the light-emitting element and a first switch tube electrically coupled with the anode of the light-emitting element. The first switch tube is configured to receive the second reset voltage in the data-writing phase. The data-writing loop is conductive in the data-writing phase, and configured to adjust the voltage of the first end of the energy-storage capacitor by receiving a data signal. The data-writing loop includes the energy-storage capacitor and a second switch tube electrically coupled with the first end of the energy-storage capacitor. The light-emitting loop is conductive in a light-emitting phase, and configured to drive the light-emitting element to emit lights by receiving a drive voltage. The light-emitting loop includes the light-emitting element and a third switch tube electrically coupled with the anode of the light-emitting element. The capacitor-reset loop includes the first switch tube, the third switch tube, the second switch tube, and the energy-storage capacitor which are connected in series in sequence. The first switch tube is further configured to receive the first reset voltage in the capacitor-reset phase. The signal processing circuit is configured to generate a drive signal according to a scan signal and a light-emitting control signal of a drive circuit row to which the signal processing circuit belongs. The drive signal at least includes a first drive signal and a second drive signal. The first drive signal is used to switch on the first switch tube and the second switch tube in the capacitor-reset phase and the data-writing phase. The second drive signal is used to switch on the third switch tube in the capacitor-reset phase and the light-emitting phase.

The drive circuit of the disclosure is configured to drive the display panel. The signal processing circuit of the drive circuit can obtain the drive signal by processing the light-emitting control signal and the scan signal of the drive circuit row to which the signal processing circuit belongs, and can output the drive signal to each pixel drive circuit in the drive circuit row to which the signal processing circuit belongs; the pixel drive circuit of the drive circuit can form the capacitor-reset loop by multiplexing the first switch tube in the light-emitting element reset loop of the pixel drive circuit, the second switch tube in the data-writing loop of the pixel drive circuit, and the third switch tube in the light-emitting loop of the pixel drive circuit. As such, the drive circuit does not need a separate reset circuit for the energy-storage capacitor, which can not only reduce an area occupied by the pixel drive circuit in a display region and improve a resolution of the display panel, but also reduce a production cost of the display panel.

Optionally, the data-writing loop further includes a fourth switch tube and a fifth switch tube. The fifth switch tube, the fourth switch tube, the second switch tube, and the energy-storage capacitor are connected in series in sequence. One end of the second switch tube is electrically coupled with the third switch tube and the fourth switch tube. A control end of the fourth switch tube is electrically coupled with the first end of the energy-storage capacitor. The data-writing loop is configured to receive the data signal through the fifth switch tube.

Optionally, the drive signal further includes a third drive signal. The third drive signal is used to switch on the fifth switch tube in the data-writing phase.

Optionally, the light-emitting loop further includes a sixth switch tube and the fourth switch tube. The sixth switch tube, the fourth switch tube, the third switch tube, and the light-emitting element are connected in series in sequence. The light-emitting loop is configured to receive the drive voltage through the sixth switch tube.

Optionally, the drive signal further includes a fourth drive signal. The fourth drive signal is used to switch on the sixth switch tube in the light-emitting phase.

Optionally, types of the first switch tube, the second switch tube, the third switch tube, the fourth switch tube, the fifth switch tube, and the sixth switch tube include a triode and a Metal-Oxide-Semiconductor (MOS) transistor.

Optionally, the first switch tube, the second switch tube, the third switch tube, the fourth switch tube, the fifth switch tube, and the sixth switch tube each are a high-level on transistor, or a low-level on transistor.

Optionally, the signal processing circuit includes a first input-end, a second input-end, a first output-end, a second output-end, a third output-end, a fourth output-end, a first phase-inverter, and a second phase-inverter. The first input-end is configured to receive the light-emitting control signal. The second input-end is configured to receive the scan signal. The first output-end is configured to output the first drive signal. The second output-end is configured to output the second drive signal. The third output-end is electrically coupled with the second input-end directly, and configured to output the scan signal as the third drive signal. The fourth output-end is electrically coupled with the first input-end directly, and configured to output the light-emitting control signal as the fourth drive signal. The first phase-inverter has an input end electrically coupled with the first input-end and an output end electrically coupled with the first output-end, and configured to invert the light-emitting control signal to obtain and output the first drive signal. The second phase-inverter has an input end electrically coupled with the second input-end and an output end electrically coupled with the second output-end, and configured to invert the scan signal to obtain and output the second drive signal.

Optionally, each of the drive circuit rows further includes a reset-voltage switching circuit. The reset-voltage switching circuit includes a first voltage-input-end, a second voltage-input-end, a voltage-output-end, a seventh switch tube, and an eighth switch tube. The first voltage-input-end is configured to receive the first reset voltage. The second voltage-input-end is configured to receive the second reset voltage. The first reset voltage is lower than the second reset voltage. The voltage-output-end is electrically coupled with each first switch tube in a drive circuit row to which the reset-voltage switching circuit belongs. The voltage-output-end is configured to output the first reset voltage or the second reset voltage. The seventh switch tube is electrically connected between the first voltage-input-end and the voltage-output-end. The seventh switch tube is configured to receive and respond to a scan signal of a previous drive circuit row, and is switched on in the capacitor-reset phase, to output the first reset voltage through the voltage-output-end. The eighth switch tube is electrically connected between the second voltage-input-end and the voltage-output-end. The eighth switch tube is configured to receive and respond to a scan signal of the drive circuit row to which the reset-voltage switching circuit belongs, and is switched on in the data-writing phase, to output the second reset voltage through the voltage-output-end.

Optionally, the light-emitting loop further includes a sixth switch tube and a fourth switch tube. The sixth switch tube, the fourth switch tube, the third switch tube, and the light-emitting element are connected in series in sequence. The light-emitting loop is configured to receive the drive voltage through the sixth switch tube.

Optionally, the third switch tube and the sixth switch tube each work in a linear region, and the fourth switch tube works in a saturation region.

The disclosure further provides a display panel. The display panel includes a gate-signal generating circuit, a reset-voltage generating circuit, and the above drive circuit. The gate-signal generating circuit is electrically coupled with the drive circuit, and configured to generate the scan signal and the light-emitting control signal to output to the drive circuit. The reset-voltage generating circuit is electrically coupled with the drive circuit, and configured to generate the first reset voltage and the second reset voltage to output to the drive circuit.

Figure 2:
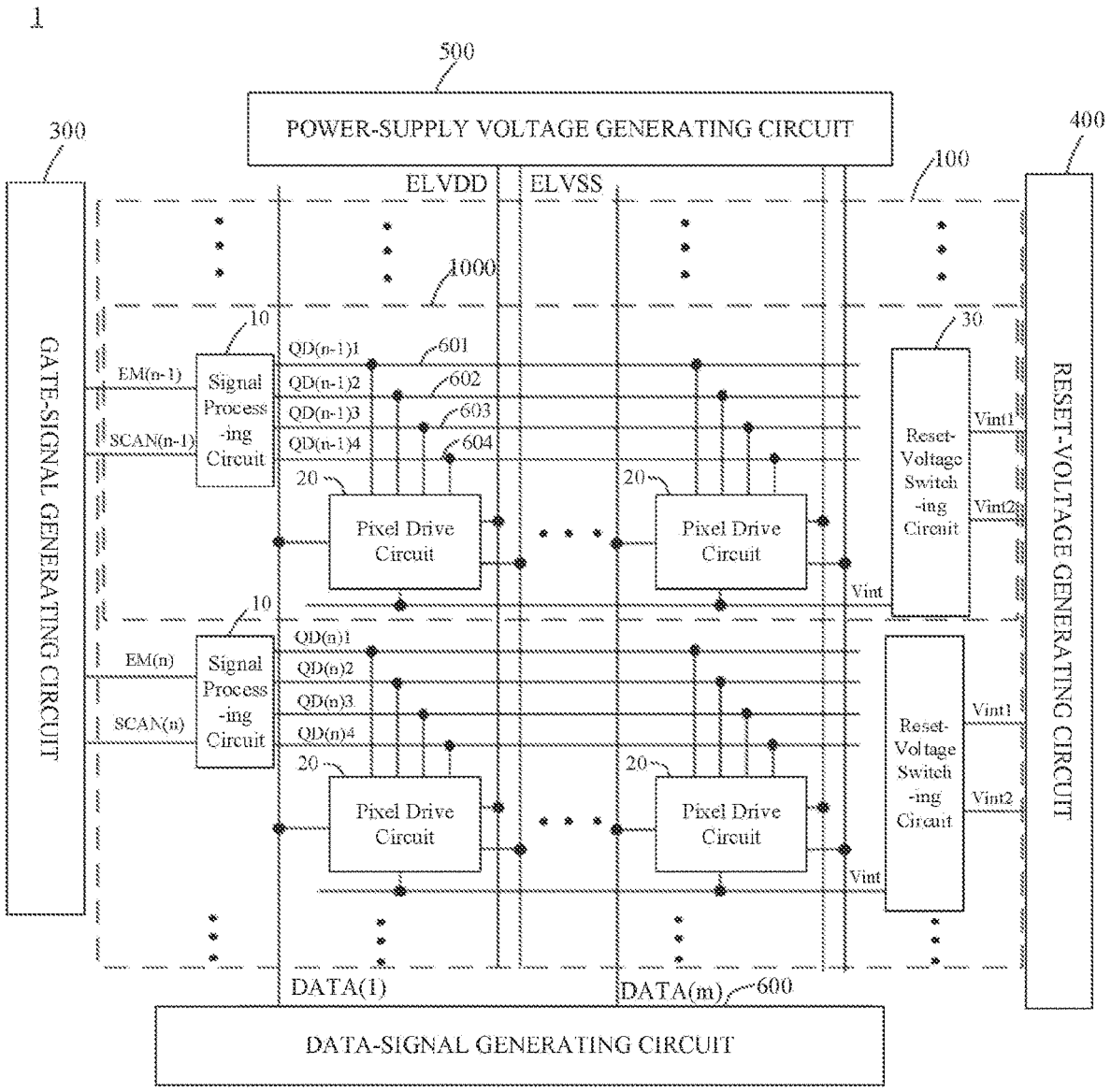
FIG. 2 is a schematic structural diagram illustrating a display panel provided in the disclosure.

Referring to FIG. 2, the disclosure provides a display panel 1. The display panel 1 includes a drive circuit 100, a gate-signal generating circuit 300, a reset-voltage generating circuit 400, a power-supply voltage generating circuit 500, and a data-signal generating circuit 600.

The drive circuit 100 includes N drive circuit rows 1000. Each of the drive circuit rows 1000 includes M pixel drive circuits 20 and a signal processing circuit 10 electrically coupled with the M pixel drive circuits 20. Each of the pixel drive circuits 20 includes a light-emitting element 200, and each pixel drive circuit 20 is configured to drive one light-emitting element 200 to emit lights. The light-emitting element 200 may be an Organic Light-Emitting Diode (OLED) or a Light-Emitting Diode (LED). Multiple pixel drive circuits 20 are arranged in an array of N rows and M columns, where M and N each are a positive integer.

The gate-signal generating circuit 300 is configured to generate a corresponding scan signal SCAN and a corresponding light-emitting control signal EM for each of the drive circuit rows 1000. In some implementations, the gate-signal generating circuit 300 includes Gate Driven on Array (GOA) and Emit scan circuit on array (EOA), where the GOA is configured to generate a scan signal SCAN for each of the drive circuit rows 1000, and the EOA is configured to generate a light-emitting control signal EM for each of the drive circuit rows 1000. In implementations of the disclosure, a signal processing circuit 10 in an $n^{th}$ drive circuit row 1000 is configured to receive a scan signal SCAN(n) and a light-emitting control signal EM(n) of a drive circuit row 1000 to which the signal processing circuit 10 belongs, where $1 \leq n \leq N$ Exemplarily, signal processing circuits 10 in multiple drive circuit rows 1000 are integrated into the GOA or the EOA, which is beneficial to realizing a slim-bezel design of the display panel 1.

In implementations of the disclosure, each of the drive circuit rows 1000 further includes a reset-voltage switching circuit 30. The reset-voltage generating circuit 400 is configured to generate a first reset voltage Vint1 and a second reset voltage Vint2, and output the first reset voltage Vint1 and the second reset voltage Vint2 to a reset-voltage switching circuit 30 in each of the drive circuit rows 1000. Each reset-voltage switching circuit 30 is configured to output the first reset voltage Vint1 or the second reset voltage Vint2. The first reset voltage Vint1 is used to reset an energy-storage capacitor C in each of the pixel drive circuits 20, and the second reset voltage Vint2 is used to reset each light-emitting element 200.

The power-supply voltage generating circuit 500 is configured to generate a drive voltage ELVDD and a reference voltage ELVSS, and output the drive voltage ELVDD and the reference voltage ELVSS to each pixel drive circuit 20. A cathode of each light-emitting element 200 is electrically coupled with the power-supply voltage generating circuit 500 to receive the reference voltage ELVSS. The drive voltage ELVDD and the reference voltage ELVSS are used to drive the light-emitting element 200 to emit lights. The drive voltage ELVDD is higher than the reference voltage ELVSS.

The data-signal generating circuit 600 is configured to generate a corresponding data signal DATA for each column of pixel drive circuits, and output the data signal DATA to each pixel drive circuit 20 in the column of pixel drive circuits.

Figure 3:
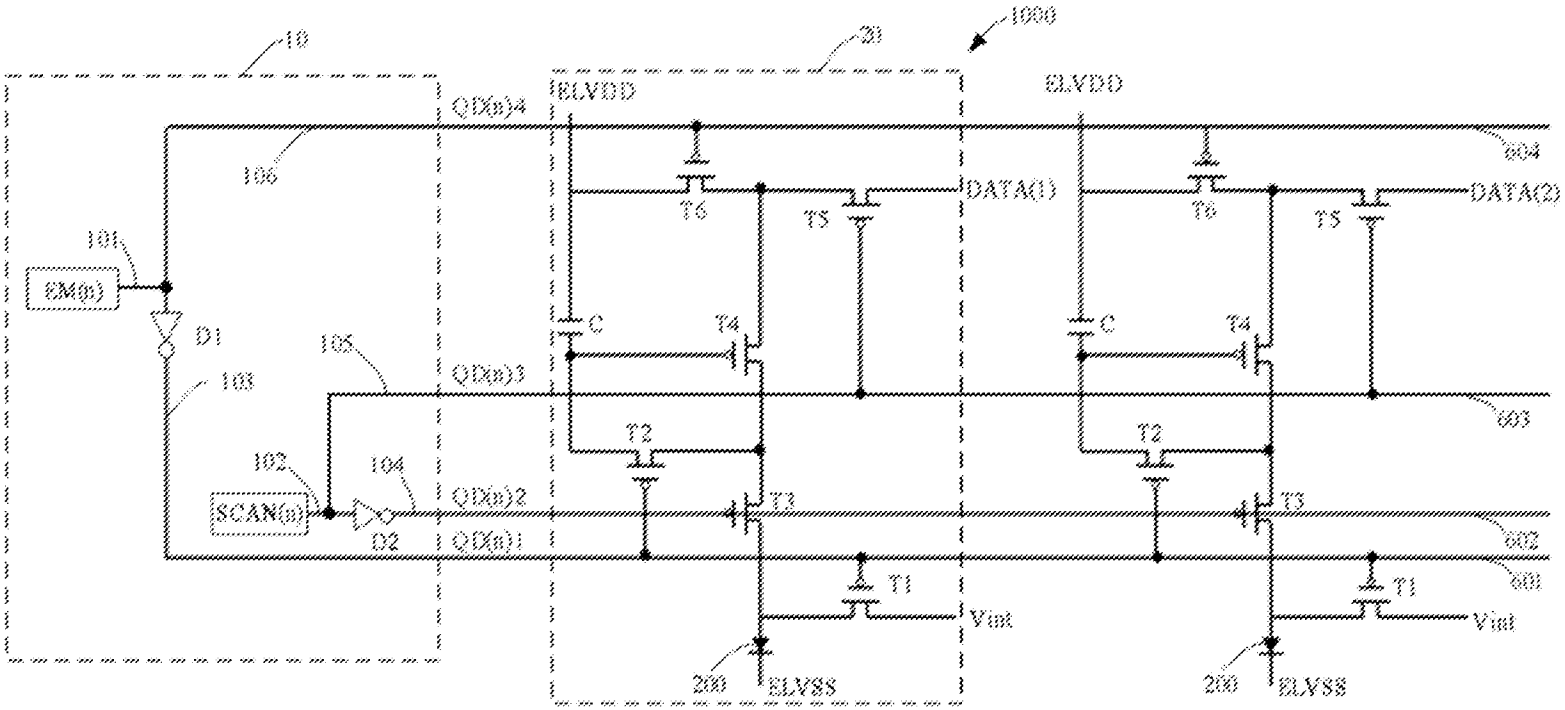
FIG. 3 is a schematic diagram illustrating a circuit structure of an $n^{th}$ drive circuit row of a drive circuit provided in the disclosure.

Referring to FIG. 3, FIG. 3 illustrates a circuit structure of a signal processing circuit 10 and part of pixel drive circuits 20 in an $n^{th}$ drive circuit row 1000 of a drive circuit 100.

Each of the pixel drive circuits 20 further includes an energy-storage capacitor C, a first switch tube T1, a second switch tube T2, a third switch tube T3, a fourth switch tube T4, a fifth switch tube T5, and a sixth switch tube T6. A control end of each of the switch tubes T1 to T3 and the switch tubes T5 to T6 is electrically coupled with the signal processing circuit 10. The switch tubes T1 to T6 each may be at least one of a triode or a MOS transistor. In these implementations, the switch tubes T1 to T6 each are a low-level on transistor, such as a P-channel MOS (PMOS) transistor. In other implementations, the switch tubes T1 to T6 each are a high-level on transistor, such as an N-channel MOS (NMOS) transistor. It can be understood that, the switch tubes T1 to T6 are designed to have a same type, which is beneficial to simplifying a manufacturing process of the drive circuit 100, and is beneficial to reducing processing difficulty and a production cost. In other implementations, the switch tubes T1 to T6 may have different types, which are not limited herein.

A circuit structure and a working principle of the pixel drive circuit 20 will be clearly depicted below with reference to FIG. 4 and FIG. 5A to FIG. 5C.

Figure 4:
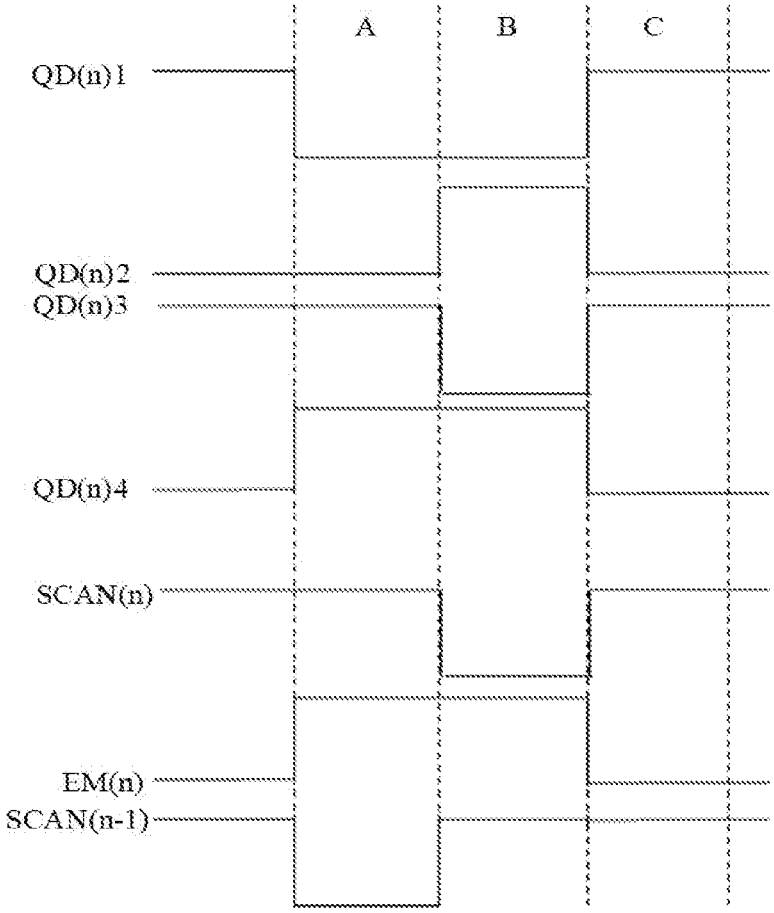
FIG. 4 is a working timing diagram of an $n^{th}$ drive circuit row of a drive circuit illustrated in FIG. 3 in one frame of scan period.

As illustrated in FIG. 4, the pixel drive circuit 20 sequentially works in a capacitor-reset phase (A phase), a data-writing phase (B phase), and a light-emitting phase (C phase) in one frame of scan period.

Figure 5A:
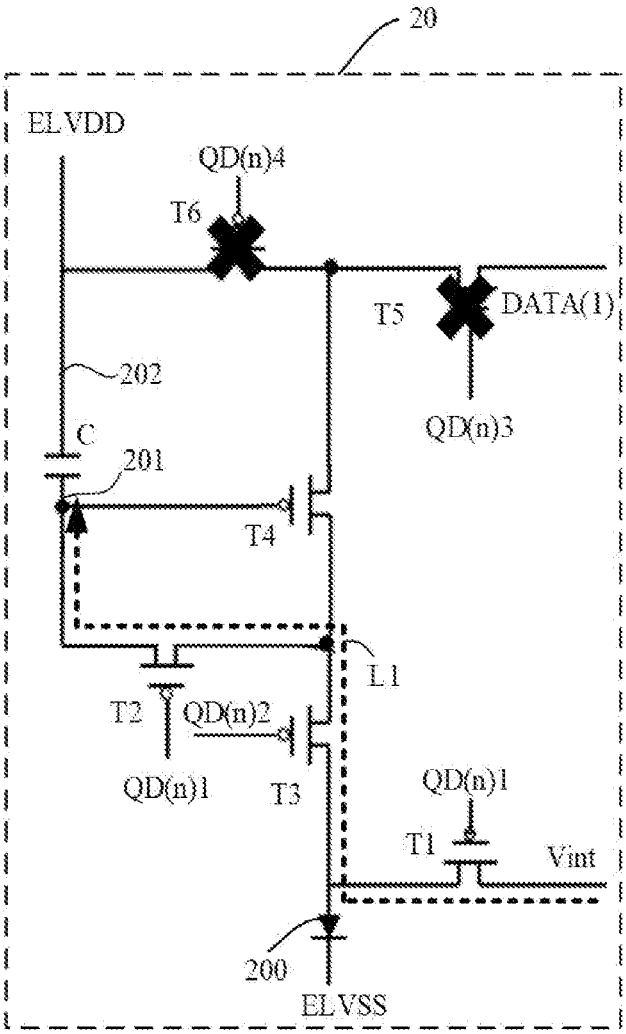
FIG. 5A is a schematic circuit diagram illustrating a pixel drive circuit of a drive circuit illustrated in FIG. 3 in a capacitor-reset phase.

As illustrated in FIG. 5A, the pixel drive circuit 20 includes a capacitor-reset loop L1. The capacitor-reset loop L1 includes a first switch tube T1, a third switch tube T3, a second switch tube T2, and an energy-storage capacitor C which are connected in series in sequence. Specifically, a first end of the first switch tube T1 is configured to receive a first reset voltage Vint1 in the capacitor-reset phase, a second end of the first switch tube T1 is electrically coupled with a first end of the third switch tube T3, a second end of the third switch tube T3 is electrically coupled with a first end of the second switch tube T2, a second end of the second switch tube T2 is electrically coupled with a first end 201 of the energy-storage capacitor C, and a second end 202 of the energy-storage capacitor C is further configured to receive a drive voltage ELVDD. In the capacitor-reset phase, the capacitor-reset loop L1 is conductive (that is, the first switch tube T1, the third switch tube T3, and the second switch tube T2 each are switched on), and is configured to reset a voltage of the first end 201 of the energy-storage capacitor C by receiving the first reset voltage Vint1, that is, the energy-storage capacitor C is charged, so that the voltage of the first end 201 of the energy-storage capacitor C is reset to the first reset voltage Vint1. As such, it is possible to eliminate influence of a previous light-emitting phase on the voltage of the energy-storage capacitor C, so that in each light-emitting phase, the voltage of the first end 201 of the energy-storage capacitor C has a same initial value (i.e., the first reset voltage Vint1), to ensure uniformity of display of the display panel 1.

Figure 5B:
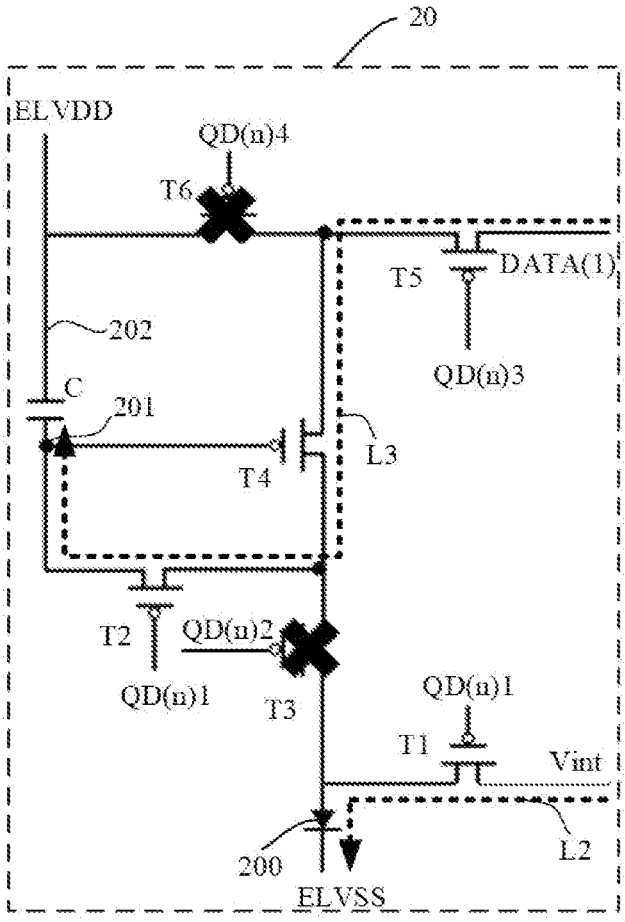
FIG. 5B is a schematic circuit diagram illustrating a pixel drive circuit of a drive circuit illustrated in FIG. 3 in a data-writing phase.

As illustrated in FIG. 5B, the pixel drive circuit 20 further includes a light-emitting element reset loop L2. The light-emitting element reset loop L2 includes a light-emitting element 200 and the first switch tube T1. The second end of the first switch tube T1 is further electrically coupled with an anode of the light-emitting element 200, and the first end of the first switch tube T1 is further configured to receive a second reset voltage Vint2 (e.g., a reference voltage ELVSS) in the data-writing phase. In the data-writing phase, the light-emitting element reset loop L2 is conductive (that is, the first switch tube T1 is switched on), and is configured to reset a voltage of the anode of the light-emitting element 200 by receiving the second reset voltage Vint2, so that the voltage of the anode of the light-emitting element 200 is reset to the second reset voltage Vint2. As such, it is possible to eliminate influence of a previous light-emitting phase on the voltage of the anode of the light-emitting element 200, so that in each the light-emitting phase, the voltage of the anode of the light-emitting element 200 has a same initial value (i.e., the second reset voltage Vint2), which can further improve uniformity of display of the display panel 1. It should be noted that, in implementations of the disclosure, the first reset voltage Vint1 is lower than the reference voltage ELVSS (i.e., Vint1<ELVSS), and therefore, the first reset voltage Vint1 will not cause the light-emitting element 200 to be triggered by mistake to emit lights in the capacitor-reset phase.

The pixel drive circuit 20 further includes a data-writing loop L3. The data-writing loop L3 includes a fifth switch tube T5, a fourth switch tube T4, the second switch tube T2, and the energy-storage capacitor C which are connected in series in sequence. Specifically, a first end of the fifth switch tube T5 is configured to receive a data signal DATA (e.g., DATA(1)), a second end of the fifth switch tube T5 is electrically coupled with a source of the fourth switch tube T4, the second switch tube T2 is electrically coupled with one end (i.e., the second end) of the third switch tube T3 and a drain of the fourth switch tube T4, and a control end (i.e., a gate) of the fourth switch tube T4 is further electrically coupled with the first end 201 of the energy-storage capacitor C. In the data-writing phase, the data-writing loop L3 is conductive (that is, the second switch tube T2, the fourth switch tube T4, and the fifth switch tube T5 each are switched on), and is configured to adjust the voltage of the first end 201 of the energy-storage capacitor C by receiving the data signal DATA.

Specifically, a voltage value of the data signal DATA(1) is defined as $V_{DATA1}$. In the data-writing phase, for the fourth switch tube T4, at start of charging the energy-storage capacitor C, a voltage Vg of the gate of the fourth switch tube T4 is equal to Vint1 (i.e., Vg=Vint1), and a voltage Vs of the source of the fourth switch tube T4 is equal to $V_{DATA1}$ (i.e., $Vs=V_{DATA1}$), in this situation, a gate-source voltage Vgs is lower than Vth (i.e., $Vgs=Vg-Vs=Vint1-V_{DATA1}<Vth$), and therefore, the four switch tube T4 is switched on. The Vth is a threshold voltage of the fourth switch tube T4. If Vgs is lower than Vth (i.e., Vgs<Vth), the fourth switch tube T4 is switched on; if Vgs is higher than Vth (i.e., Vgs>Vth), the fourth switch tube T4 is switched off. The energy-storage capacitor C is charged with the data signal DATA(1) through the conductive data-writing loop L3, so that the voltage of the first end 201 of the energy-storage capacitor C increases continuously. Once the voltage of the first end 201 of the energy-storage capacitor C increases to a sum of $V_{DATA1}$ and Vth (i.e., $Vg=V_{DATA1}+Vth$), since Vgs is equal to Vth (i.e., $Vgs=V_{DATA1}+Vth-V_{DATA1}=Vth$), the fourth switch tube T4 is in a critical off state, and thus, the voltage of the first end 201 of the energy-storage capacitor C no longer increases.

Figure 5C:
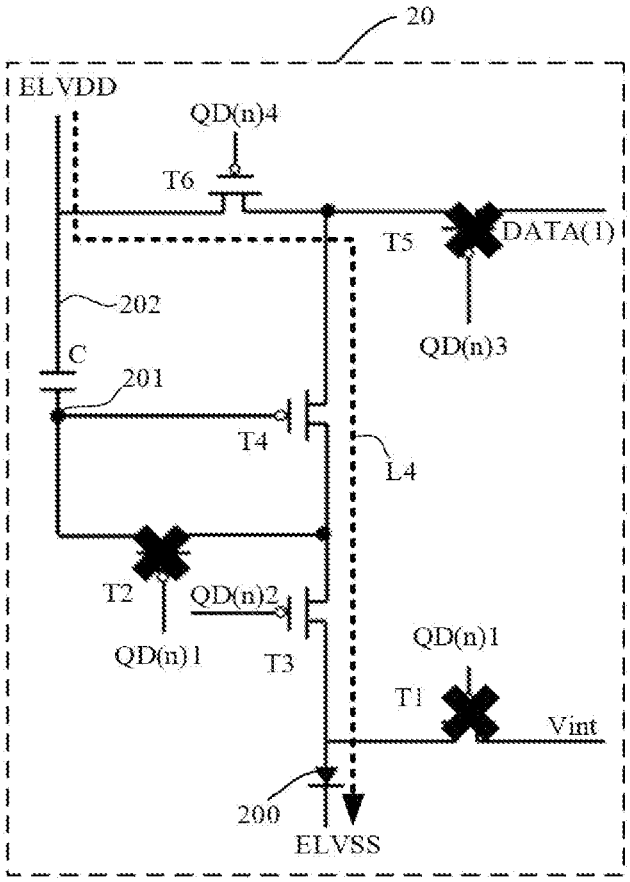
FIG. 5C is a schematic circuit diagram illustrating a pixel drive circuit of a drive circuit illustrated in FIG. 3 in a light-emitting phase.

As illustrated in FIG. 5C, the pixel drive circuit 20 further includes a light-emitting loop L4. The light-emitting loop L4 includes a sixth switch tube T6, the fourth switch tube T4, the third switch tube T3, and the light-emitting element 200 which are connected in series in sequence. Specifically, a first end of the sixth switch tube T6 is electrically coupled with the second end 202 of the energy-storage capacitor C, the first end of the sixth switch tube T6 is configured to receive a drive voltage ELVDD, a second end of the sixth switch tube T6 is electrically coupled with the source of the fourth switch tube T4. In the light-emitting phase, the light-emitting loop L4 is conductive (that is, the third switch tube T3, the fourth switch tube T4, and the sixth switch tube T6 each are switched on), and is configured to drive the light-emitting element 200 to emit lights by receiving the drive voltage ELVDD.

Specifically, for the fourth switch tube T4, in the light-emitting phase, the voltage Vg of the gate of the fourth switch tube T4 is equal to a sum of $V_{DATA1}$ and Vth (i.e., $Vg=V_{DATA1}+Vth$), and the voltage Vs of the source of the fourth switch tube T4 is equal to ELVDD (i.e., Vs=ELVDD), in this situation, the gate-source voltage Vgs is lower than Vth (i.e., $Vgs=Vg-Vs=V_{DATA1}+Vth-ELVDD<Vth$), and therefore, the fourth switch tube T4 is switched on.

In addition, in implementations of the disclosure, in the light-emitting phase, since the third switch tube T3 and the sixth switch tube T6 each work in a linear region (i.e., a region where a drain current Id has a linear response to changes in a drain-source voltage Vds) and the fourth switch tube T4 works in a saturation region (i.e., a region where change in the drain-source voltage Vds will not produce significant change in the drain current Id), a magnitude of a current flowing through the light-emitting element 200 mainly depends on a current Ids between the source of the fourth switch tube T4 and the drain of the fourth switch tube T4. According to working characteristics of the switch tube, the current Ids and the gate-source voltage Vgs satisfy the following relationship:

$$Ids=(K/2)(Vgs-Vth)^2=(K/2)(V_{DATA1}-ELVDD)^2$$

where K=Cox×μ×W/L, Cox represents a gate capacitance per unit area, u represents an electron mobility in a channel, and W/L represents a width-to-length ratio of the channel of the fourth switch tube T4.

Based on the above formula, the data-writing loop L3 can provide a compensation voltage for the fourth switch tube T4, so that the current Ids flowing through the light-emitting element 200 is unrelated to the threshold voltage Vth of the fourth switch tube T4. As such, a phenomenon of uneven display brightness caused by differences in threshold voltages Vth of fourth switch tubes T4 of different pixel drive circuits can be eliminated.

Referring to FIG. 2 to FIG. 4 again, the signal processing circuit 10 is configured to generate a drive signal according to a scan signal SCAN(n) and a light-emitting control signal EM(n) of a drive circuit row 1000 to which the signal processing circuit 10 belongs. In implementations of the disclosure, the drive signal at least includes a first drive signal QD(n)1 and a second drive signal QD(n)2. The first drive signal QD(n)1 is used to switch on the first switch tube T1 and the second switch tube T2 in the capacitor-reset phase and the data-writing phase, and switch off the first switch tube T1 and the second switch tube T2 in the light-emitting phase. The second drive signal QD(n)2 is used to switch on the third switch tube T3 in the capacitor-reset phase and the light-emitting phase, and switch off the third switch tube T3 in the data-writing phase.

The drive signal further includes a third drive signal QD(n)3. The third drive signal QD(n)3 is used to switch on the fifth switch tube T5 in the data-writing phase, and switch off the fifth switch tube T5 in the capacitor-reset phase and the light-emitting phase.

The drive signal further includes a fourth drive signal QD(n)4. The fourth drive signal QD(n)4 is used to switch on the sixth switch tube T6 in the light-emitting phase, and switch off the sixth switch tube T6 in the capacitor-reset phase and the data-writing phase.

As illustrated in FIG. 3, each signal processing circuit 10 includes a first input-end 101, a second input-end 102, a first output-end 103, a second output-end 104, a third output-end 105, a fourth output-end 106, a first phase-inverter D1, and a second phase-inverter D2.

The first input-end 101 and the second input-end 102 are electrically coupled with the gate-signal generating circuit 300, where the first input-end 101 is configured to receive a light-emitting control signal EM(n), and the second input-end 102 is configured to receive a scan signal SCAN(n).

The fourth output-end 106 is electrically coupled with the first input-end 101 directly, and configured to use the light-emitting control signal EM(n) as the fourth drive signal QD(n)4, to output, through a drive-signal line 604, the fourth drive signal QD(n)4 to each pixel drive circuit 20 in a drive circuit row 1000 to which the signal processing circuit 10 belongs. The fourth drive signal QD(n)4 and the light-emitting control signal EM(n) satisfy the following relationship:

$$QD(n)4=EM(n)$$

The third output-end 105 is electrically coupled with the second input-end 102 directly, and configured to use the scan signal SCAN(n) as the third drive signal QD(n)3, to output, through a drive-signal line 603, the third drive signal QD(n)3 to each pixel drive circuit 20 in the drive circuit row 1000 to which the signal processing circuit 10 belongs. The third drive signal QD(n)3 and the scan signal SCAN(n) satisfy the following relationship:

$$QD(n)3=\mathrm{SCAN}(n)$$

The first output-end 103 is configured to output, through a drive-signal line 601, the first drive signal QD(n)1 to each pixel drive circuit 20 in the drive circuit row 1000 to which the signal processing circuit 10 belongs. The second output-end 104 is configured to output, through a drive-signal line 602, the second drive signal QD(n)2 to each pixel drive circuit 20 in the drive circuit row 1000 to which the signal processing circuit 10 belongs.

An input end of the first phase-inverter D1 is electrically coupled with the first input-end 101, and an output end of the first phase-inverter D1 is electrically coupled with the first output-end 103. The first phase-inverter D1 is configured to invert the light-emitting control signal EM(n) to obtain and output the first drive signal QD(n)1. The first drive signal QD(n)1 and the light-emitting control signal EM(n) satisfy the following relationship:

$$QD(n)1=\overline{EM(n)}$$

An input end of the second phase-inverter D2 is electrically coupled with the second input-end 102, and an output end 104 of the second phase-inverter D2 is electrically coupled with the second output-end 104. The second phase-inverter D2 is configured to invert the scan signal SCAN(n) to obtain and output the second drive signal QD(n)2. The second drive signal QD(n)2 and the scan signal SCAN(n) satisfy the following relationship:

$$QD(n)2=\overline{\mathrm{SCAN}(n)}$$

Figure 6:
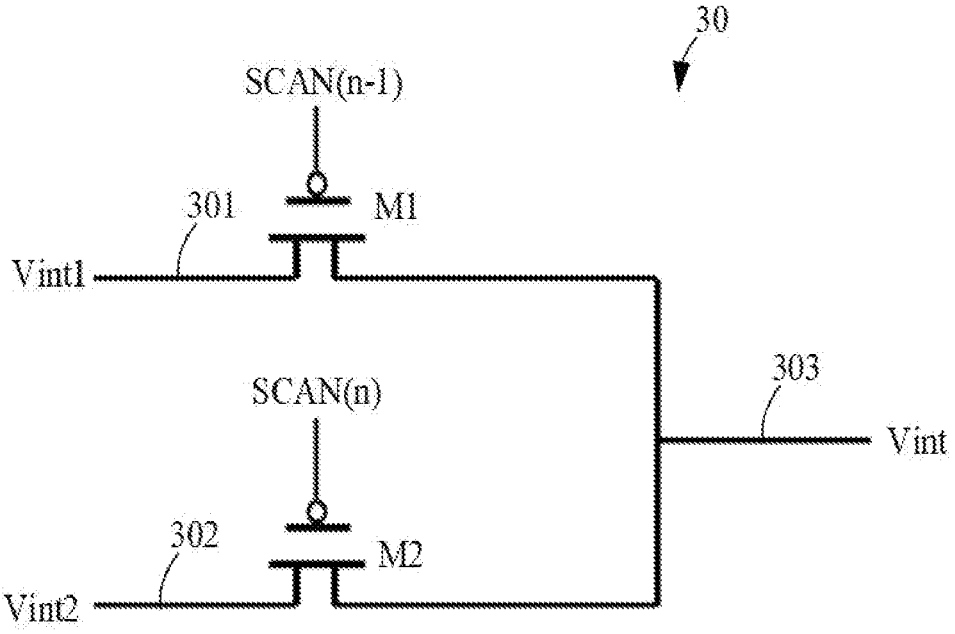
FIG. 6 is a schematic diagram illustrating a circuit structure of a reset-voltage switching circuit of a display panel illustrated in FIG. 2.

Referring to FIG. 2 and FIG. 6, each of the drive circuit rows 1000 further includes a reset-voltage switching circuit 30. The reset-voltage switching circuit 30 includes a first voltage-input-end 301, a second voltage-input-end 302, a voltage-output-end 303, a seventh switch tube M1, and an eighth switch tube M2.

The first voltage-input-end 301 and the second voltage-input-end 302 are electrically coupled with the reset-voltage generating circuit 400, where the first voltage-input-end 301 is configured to receive a first reset voltage Vint1, the second voltage-input-end 102 is configured to receive a second reset voltage Vint2, and the first reset voltage Vint1 is lower than the second reset voltage Vint2.

The voltage-output-end 303 is electrically coupled with a first end of each first switch tube T1 in a drive circuit row 1000 to which the reset-voltage switching circuit 30 belongs, and configured to output the first reset voltage Vint1 or the second reset voltage Vint2 to each first switch tube T1 in the drive circuit row 1000 to which the reset-voltage switching circuit 30 belongs.

The seventh switch tube M1 is electrically connected between the first voltage-input-end 301 and the voltage-output-end 303, and a control end of the seventh switch tube M1 is further electrically coupled with the gate-signal generating circuit 300. The seventh switch tube M1 is configured to receive and respond to a scan signal SCAN(n−1) of a previous drive circuit row 1000, and is switched on in the capacitor-reset phase, to output the first reset voltage Vint1 through the voltage-output-end 303.

The eighth switch tube M2 is electrically connected between the second voltage-input-end 302 and the voltage-output-end 303, and a control end of the eighth switch tube M2 is further electrically coupled with the gate-signal generating circuit 300. The eighth switch tube M2 is configured to receive and respond to a scan signal SCAN(n) of a drive circuit row 1000 to which the reset-voltage switching circuit 30 belongs, and is switched on in the data-writing phase, to output the second reset voltage Vint2 through the voltage-output-end 303. The seventh switch tube M1 and the eighth switch tube M2 are the same as the sixth switch tube T6 in terms of type. In implementations of the disclosure, the seventh switch tube M1 and the eighth switch tube M2 each are a low-level on transistor, such as a PMOS transistor.

As mentioned above, in these implementations, the switch tubes T1 to T6 and the switch tubes M1 to M2 each are a low-level on transistor. In the following, a working process of an $n^{th}$ drive circuit row 1000 of a drive circuit 100 of the disclosure in one frame of scan period will be depicted in detail with reference to FIG. 3 to FIG. 6.

In a capacitor-reset phase (A phase), a scan signal SCAN (n−1) of a previous drive circuit row 1000 is at low level, and a light-emitting control signal EM(n) and a scan signal SCAN(n) of a present drive circuit row 1000 each are at high level, and thus, the seventh switch tube M1 is switched on and the eighth switch tube M2 is switched off, so that the voltage-output-end 303 outputs a first reset voltage Vint1. According to the above contents, the first drive signal QD(n)1 and the second drive signal QD(n)2 each are at low level, and the third drive signal QD(n)3 and the fourth drive signal QD(n)4 each are at high level, and therefore, the switch tubes T1 to T3 each are switched on while the switch tubes T5 to T6 each are switched off, so that a capacitor-reset loop L1 is conductive to receive the first reset voltage Vint1 to reset a voltage of a first end 201 of an energy-storage capacitor C.

In a data-writing phase (B phase), as stated above, the fourth switch tube T4 is switched on. The scan signal SCAN(n) of the present drive circuit row 1000 is at low level, and the scan signal SCAN(n−1) of the previous drive circuit row 1000 and the light-emitting control signal EM(n) of the present drive circuit row 1000 each are at high level, and thus, the seventh switch tube M1 is switched off and the eighth switch tube M2 is switched on, so that the voltage-output-end 303 outputs a second reset voltage Vint2. According to the above contents, the first drive signal QD(n)1 and the third drive signal QD(n)3 each are at low level, and the second drive signal QD(n)2 and the fourth drive signal QD(n)4 each are at high level, and therefore, the switch tubes T1, T2, T4, and T5 each are switched on while the switch tubes T3 and T6 each are switched off, so that a light-emitting element reset loop L2 is conductive to receive the second reset voltage Vint2 to reset a voltage of an anode of a light-emitting element 200, and a data-writing loop L3 is conductive to receive a data signal DATA to adjust the voltage of the first end 201 of the energy-storage capacitor C.

In a light-emitting phase (C phase), as stated above, the fourth switch tube T4 is switched on. The scan signal SCAN(n−1) of the previous drive circuit row 1000 and the scan signal SCAN(n) of the present drive circuit row 1000 each are at high level, and the light-emitting control signal EM(n) of the present drive circuit row 1000 is at low level, based on these contents, the first drive signal QD(n)1 and the third drive signal QD(n)3 each are at high level, and the second drive signal QD(n)2 and the fourth drive signal QD(n)4 each are at low level, and therefore, the switch tubes T3, T4, and T6 each are switched on while the switch tubes T1, T2, and T5 each are switched off, so that a light-emitting loop L4 is conductive to receive a drive voltage ELVDD to drive the light-emitting element 200 to emit lights.

Figure 7:
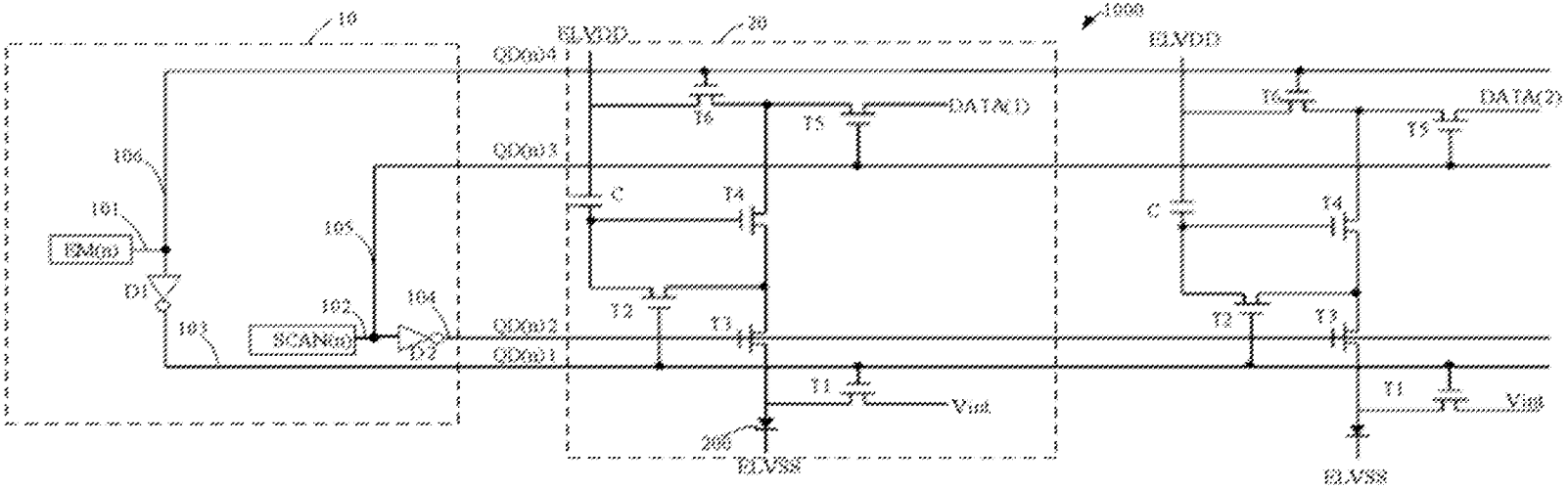
FIG. 7 is a schematic diagram illustrating a circuit structure of an $n^{th}$ drive circuit row of another drive circuit provided in the disclosure.
Figure 8:
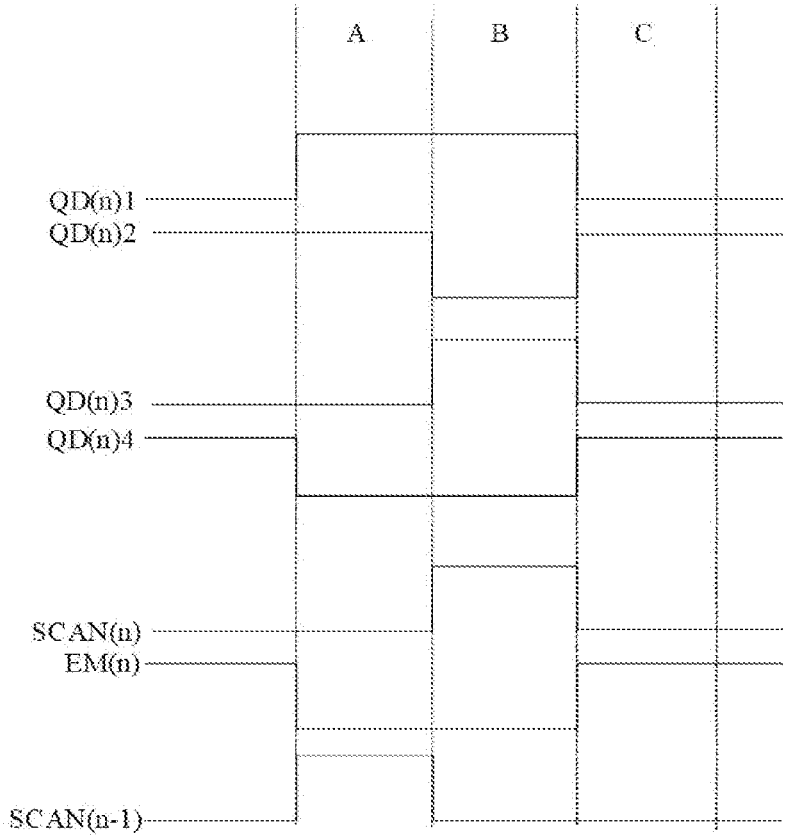
FIG. 8 is a working timing diagram of an $n^{th}$ drive circuit row of a drive circuit illustrated in FIG. 7 in one frame of scan period.

Referring to FIG. 7 to FIG. 8, the disclosure further provides another drive circuit 100. Compared to the drive circuit of the foregoing implementations, a difference lies in that: the switch tubes T1 to T6 and the switch tubes M1 to M2 each are a high-level on transistor. A working timing diagram of an $n^{th}$ drive circuit row of the drive circuit 100 of this implementation in one frame of scan period is illustrated in FIG. 8, and a specific working process is the same as the working process described in the foregoing implementations, which will not be repeated herein. It should be noted that, in this implementation, since the fourth switch tube T4 is a high-level on transistor, the first reset voltage Vint1 must be a positive voltage, so that the fourth switch tube T4 can be switched on. In order to ensure that the light-emitting element 200 is not triggered by mistake to emit lights in the capacitor-reset phase, the reference voltage ELVSS needs to be higher than the first reset voltage Vint1, and therefore, the reference voltage ELVSS must also be a positive voltage. In addition, the drive voltage ELVDD needs to be higher than the reference voltage ELVSS, so that the light-emitting element 200 can emit lights. As can be seen, the drive voltage ELVDD in this implementation is higher than the drive voltage ELVDD in foregoing implementations.

It should be noted that, the circuit structures of the signal processing circuit 10 of the drive circuit 100 illustrated in FIG. 3 and the signal processing circuit 10 of the drive circuit 100 illustrated in FIG. 7 are merely exemplary and do not constitute a limitation to the disclosure. The circuit structure of the signal processing circuit 10 can be designed according to types of the switch tubes T1 to T6. Exemplarily, in still another implementation, if the switch tubes T1 to T3 each are a high-level on transistor and the switch tubes T4 to T6 each are a low-level on transistor, QD(n) 4=QD(n) 1=EM(n), QD(n)3=QD(n)2=SCAN(n). In this situation, the signal processing circuit 10 can be designed to use the scan signal SCAN(n) as the second drive signal QD(n)2 and the third drive signal QD(n)3 for outputting, and use the light-emitting control signal EM(n) as the first drive signal QD(n)1 and the fourth drive signal QD(n)4 for outputting. Any similar change made to the circuit structure shall fall within the protection scope of the disclosure, which is not exhaustive herein.

The drive circuit 100 of the disclosure is configured to drive the display panel 1. The signal processing circuit 10 of the drive circuit 100 can obtain the drive signal by processing the light-emitting control signal and the scan signal of the drive circuit row 1000 to which the signal processing circuit 10 belongs, and can output the drive signal to each pixel drive circuit 20 in the drive circuit row 1000 to which the signal processing circuit 10 belongs; the pixel drive circuit 20 of the drive circuit 100 can form the capacitor-reset loop L1 by multiplexing the first switch tube T1 in the light-emitting element reset loop L2 of the pixel drive circuit 20, the second switch tube T2 in the data-writing loop L3 of the pixel drive circuit 20, and the third switch tube T3 in the light-emitting loop L4 of the pixel drive circuit 20. As such, the drive circuit 100 does not need a separate reset circuit for the energy-storage capacitor C, so that each pixel drive circuit 20 can reduce a switch tube compared to the existing drive circuit, which can not only reduce an area occupied by the pixel drive circuit 20 in a display region and improve a resolution of the display panel 1, but also reduce a production cost of the display panel 1.

While the implementations of the disclosure have been illustrated and depicted above, it will be understood by those of ordinary skill in the art that various changes, modifications, substitutions, and alterations can be made to these implementations without departing from the principles and spirits of the disclosure. Therefore, the scope of the disclosure is defined by the appended claims and equivalents of the appended claims.

What is claimed is:

1. A drive circuit of a display panel, comprising a plurality of drive circuit rows, the plurality of drive circuit rows each comprising a plurality of pixel drive circuits and a signal processing circuit electrically coupled with the plurality of pixel drive circuits;

wherein the pixel drive circuits each comprise:

a light-emitting element, wherein the pixel drive circuit is configured to drive the light-emitting element to emit lights;

an energy-storage capacitor;

a capacitor-reset loop, being conductive in a capacitor-reset phase, and configured to reset a voltage of a first end of the energy-storage capacitor by receiving a first reset voltage;

a light-emitting element reset loop, being conductive in a data-writing phase, and configured to reset a voltage of an anode of the light-emitting element by receiving a second reset voltage, wherein the light-emitting element reset loop comprises the light-emitting element and a first switch tube electrically coupled with the anode of the light-emitting element, and the first switch tube is configured to receive the second reset voltage in the data-writing phase;

a data-writing loop, being conductive in the data-writing phase, and configured to adjust the voltage of the first end of the energy-storage capacitor by receiving a data signal, wherein the data-writing loop comprises the energy-storage capacitor and a second switch tube electrically coupled with the first end of the energy-storage capacitor; and a light-emitting loop, being conductive in a light-emitting phase, and configured to drive the light-emitting element to emit lights by receiving a drive voltage, wherein the light-emitting loop comprises the light-emitting element and a third switch tube electrically coupled with the anode of the light-emitting element, wherein the capacitor-reset loop comprises the first switch tube, the third switch tube, the second switch tube, and the energy-storage capacitor which are connected in series in sequence, and the first switch tube is further configured to receive the first reset voltage in the capacitor-reset phase;

the signal processing circuit is configured to generate a drive signal according to a scan signal and a light-emitting control signal of a drive circuit row to which the signal processing circuit belongs, and the drive signal at least comprises:

a first drive signal used to switch on the first switch tube and the second switch tube in the capacitor-reset phase and the data-writing phase; and a second drive signal used to switch on the third switch tube in the capacitor-reset phase and the light-emitting phase; and the signal processing circuit is configured to invert the light-emitting control signal to obtain the first drive signal, and invert the scan signal to obtain the second drive signal.

2. The drive circuit of claim 1, wherein the data-writing loop further comprises a fourth switch tube and a fifth switch tube, wherein the fifth switch tube, the fourth switch tube, the second switch tube, and the energy-storage capacitor are connected in series in sequence, one end of the second switch tube is electrically coupled with the third switch tube and the fourth switch tube, and a control end of the fourth switch tube is further electrically coupled with the first end of the energy-storage capacitor; wherein the data-writing loop is configured to receive the data signal through the fifth switch tube.

3. The drive circuit of claim 2, wherein the drive signal further comprises a third drive signal, the third drive signal is used to switch on the fifth switch tube in the data-writing phase.

4. The drive circuit of claim 3, wherein the light-emitting loop further comprises a sixth switch tube and the fourth switch tube, and the sixth switch tube, the fourth switch tube, the third switch tube, and the light-emitting element are connected in series in sequence; wherein the light-emitting loop is configured to receive the drive voltage through the sixth switch tube.

5. The drive circuit of claim 4, wherein the drive signal further comprises a fourth drive signal, the fourth drive signal is used to switch on the sixth switch tube in the light-emitting phase.

6. The drive circuit of claim 5, wherein types of the first switch tube, the second switch tube, the third switch tube, the fourth switch tube, the fifth switch tube, and the sixth switch tube comprise a triode and a Metal-Oxide-Semiconductor (MOS) transistor.

7. The drive circuit of claim 6, wherein the first switch tube, the second switch tube, the third switch tube, the fourth switch tube, the fifth switch tube, and the sixth switch tube each are a high-level on transistor or a low-level on transistor.

8. The drive circuit of claim 7, wherein each signal processing circuit comprises:

a first input-end, configured to receive the light-emitting control signal;

a second input-end, configured to receive the scan signal;

a first output-end, configured to output the first drive signal;

a second output-end, configured to output the second drive signal;

a third output-end, electrically coupled with the second input-end directly, and configured to output the scan signal as the third drive signal;

a fourth output-end, electrically coupled with the first input-end directly, and configured to output the light-emitting control signal as the fourth drive signal;

a first phase-inverter, having an input end electrically coupled with the first input-end and an output end electrically coupled with the first output-end, and configured to invert the light-emitting control signal to obtain and output the first drive signal; and a second phase-inverter, having an input end electrically coupled with the second input-end and an output end electrically coupled with the second output-end, and configured to invert the scan signal to obtain and output the second drive signal.

9. The drive circuit of claim 2, wherein each of the drive circuit rows further comprises a reset-voltage switching circuit, the reset-voltage switching circuit comprises:

a first voltage-input-end, configured to receive the first reset voltage;

a second voltage-input-end, configured to receive the second reset voltage, wherein the first reset voltage is lower than the second reset voltage;

a voltage-output-end, electrically coupled with each first switch tube in a drive circuit row to which the reset-voltage switching circuit belongs, wherein the voltage-output-end is configured to output the first reset voltage or the second reset voltage;

a seventh switch tube, electrically connected between the first voltage-input-end and the voltage-output-end, wherein the seventh switch tube is configured to receive and respond to a scan signal of a previous drive circuit row, and is switched on in the capacitor-reset phase, to output the first reset voltage through the voltage-output-end; and an eighth switch tube, electrically connected between the second voltage-input-end and the voltage-output-end, wherein the eighth switch tube is configured to receive and respond to a scan signal of the drive circuit row to which the reset-voltage switching circuit belongs, and is switched on in the data-writing phase, to output the second reset voltage through the voltage-output-end.

10. The drive circuit of claim 1, wherein the light-emitting loop further comprises a sixth switch tube and a fourth switch tube, and the sixth switch tube, the fourth switch tube, the third switch tube, and the light-emitting element are connected in series in sequence; wherein the light-emitting loop is configured to receive the drive voltage through the sixth switch tube.

11. The drive circuit of claim 10, wherein the third switch tube and the sixth switch tube each work in a linear region, and the fourth switch tube works in a saturation region.

12. A display panel, comprising:

a drive circuit, comprising a plurality of drive circuit rows, wherein the plurality of drive circuit rows each comprise a plurality of pixel drive circuits and a signal processing circuit electrically coupled with the plurality of pixel drive circuits, and the plurality of pixel drive circuits each comprise:

a light-emitting element, wherein the pixel drive circuit is configured to drive the light-emitting element to emit lights;

an energy-storage capacitor;

a capacitor-reset loop, being conductive in a capacitor-reset phase, and configured to reset a voltage of a first end of the energy-storage capacitor by receiving a first reset voltage;

a light-emitting element reset loop, being conductive in a data-writing phase, and configured to reset a voltage of an anode of the light-emitting element by receiving a second reset voltage, wherein the light-emitting element reset loop comprises the light-emitting element and a first switch tube electrically coupled with the anode of the light-emitting element, and the first switch tube is configured to receive the second reset voltage in the data-writing phase;

a data-writing loop, being conductive in the data-writing phase, and configured to adjust the voltage of the first end of the energy-storage capacitor by receiving a data signal, wherein the data-writing loop comprises the energy-storage capacitor and a second switch tube electrically coupled with the first end of the energy-storage capacitor; and a light-emitting loop, being conductive in a light-emitting phase, and configured to drive the light-emitting element to emit lights by receiving a drive voltage, wherein the light-emitting loop comprises the light-emitting element and a third switch tube electrically coupled with the anode of the light-emitting element, wherein the capacitor-reset loop comprises the first switch tube, the third switch tube, the second switch tube, and the energy-storage capacitor which are connected in series in sequence, and the first switch tube is further configured to receive the first reset voltage in the capacitor-reset phase;

the signal processing circuit is configured to generate a drive signal according to a scan signal and a light-emitting control signal of a drive circuit row to which the signal processing circuit belongs, and the drive signal at least comprises:

a first drive signal used to switch on the first switch tube and the second switch tube in the capacitor-reset phase and the data-writing phase; and a second drive signal used to switch on the third switch tube in the capacitor-reset phase and the light-emitting phase; and the signal processing circuit is configured to invert the light-emitting control signal to obtain the first drive signal, and invert the scan signal to obtain the second drive signal;

a gate-signal generating circuit, electrically coupled with the drive circuit, and configured to generate the scan signal and the light-emitting control signal to output to the drive circuit; and a reset-voltage generating circuit, electrically coupled with the drive circuit, and configured to generate the first reset voltage and the second reset voltage to output to the drive circuit.

13. The display panel of claim 12, wherein the data-writing loop further comprises a fourth switch tube and a fifth switch tube, wherein the fifth switch tube, the fourth switch tube, the second switch tube, and the energy-storage capacitor are connected in series in sequence, one end of the second switch tube is electrically coupled with the third switch tube and the fourth switch tube, and a control end of the fourth switch tube is further electrically coupled with the first end of the energy-storage capacitor; wherein the data-writing loop is configured to receive the data signal through the fifth switch tube.

14. The display panel of claim 13, wherein the drive signal further comprises a third drive signal, the third drive signal is used to switch on the fifth switch tube in the data-writing phase.

15. The display panel of claim 14, wherein the light-emitting loop further comprises a sixth switch tube and the fourth switch tube, and the sixth switch tube, the fourth switch tube, the third switch tube, and the light-emitting element are connected in series in sequence; wherein the light-emitting loop is configured to receive the drive voltage through the sixth switch tube.

16. The display panel of claim 15, wherein the drive signal further comprises a fourth drive signal, the fourth drive signal is used to switch on the sixth switch tube in the light-emitting phase.

17. The display panel of claim 16, wherein types of the first switch tube, the second switch tube, the third switch tube, the fourth switch tube, the fifth switch tube, and the sixth switch tube comprise a triode and a Metal-Oxide-Semiconductor (MOS) transistor.

18. The display panel of claim 17, wherein the first switch tube, the second switch tube, the third switch tube, the fourth switch tube, the fifth switch tube, and the sixth switch tube each are a high-level on transistor or a low-level on transistor.

19. The display panel of claim 18, wherein each signal processing circuit comprises:

a first input-end, configured to receive the light-emitting control signal;

a second input-end, configured to receive the scan signal;

a first output-end, configured to output the first drive signal;

a second output-end, configured to output the second drive signal;

a third output-end, electrically coupled with the second input-end directly, and configured to output the scan signal as the third drive signal;

a fourth output-end, electrically coupled with the first input-end directly, and configured to output the light-emitting control signal as the fourth drive signal;

a first phase-inverter, having an input end electrically coupled with the first input-end and an output end electrically coupled with the first output-end, and configured to invert the light-emitting control signal to obtain and output the first drive signal; and a second phase-inverter, having an input end electrically coupled with the second input-end and an output end electrically coupled with the second output-end, and configured to invert the scan signal to obtain and output the second drive signal.

20. The display panel of claim 13, wherein each of the drive circuit rows further comprises a reset-voltage switching circuit, the reset-voltage switching circuit comprises:

a first voltage-input-end, configured to receive the first reset voltage;

a second voltage-input-end, configured to receive the second reset voltage, wherein the first reset voltage is lower than the second reset voltage;

a voltage-output-end, electrically coupled with each first switch tube in a drive circuit row to which the reset-voltage switching circuit belongs, wherein the voltage-output-end is configured to output the first reset voltage or the second reset voltage;

a seventh switch tube, electrically connected between the first voltage-input-end and the voltage-output-end, wherein the seventh switch tube is configured to receive and respond to a scan signal of a previous drive circuit row, and is switched on in the capacitor-reset phase, to output the first reset voltage through the voltage-output-end; and an eighth switch tube, electrically connected between the second voltage-input-end and the voltage-output-end, wherein the eighth switch tube is configured to receive and respond to a scan signal of the drive circuit row to which the reset-voltage switching circuit belongs, and is switched on in the data-writing phase, to output the second reset voltage through the voltage-output-end.

* * * * *